US006098599A

United States Patent [19]

Muldoon et al.

[11] Patent Number: 6,098,599

[45] Date of Patent: Aug. 8, 2000

[54] SYSTEM FOR DELIVERING FUEL TO A MOTOR VEHICLE ENGINE AND RELATED METHOD

[75] Inventors: Patrick T. Muldoon, Adrian; Robert B. Hutter; Larry F. Popp, both of South Lyon; Eric P. Thorne, Livonia, all of Mich.

[73] Assignee: Chrysler Corporation, Auburn Hills, Mich.

[21] Appl. No.: 09/145,741

[22] Filed: Sep. 2, 1998

[51] Int. Cl.[7] ..... F02M 37/04; F02M 41/00

[52] U.S. Cl. ..... 123/514; 123/457

[58] Field of Search ..... 123/510, 509, 123/514, 457

[56] References Cited

U.S. PATENT DOCUMENTS 4,498,334 2/1985 Riesenberg ..... 73/113
5,261,366 11/1993 Regueiro ..... 123/299
5,584,277 12/1996 Chen et al. ..... 123/480
5,749,345 5/1998 Treml ..... 123/456
5,762,048 6/1998 Yonekawa ..... 123/514

*Primary Examiner*—Henry C. Yuen
*Assistant Examiner*—Mahmoud M Gimie
*Attorney, Agent, or Firm*—James R. Yee

[57] ABSTRACT

A system for delivering fuel to a motor vehicle engine includes a fuel sending unit and a self-cleaning filter. The fuel sending unit is in fluid communication with the engine, which in the preferred embodiment is a fuel injected engine. A fuel regulator is provided interbetween the fuel sending unit and the engine which delivers a first portion of the fuel to the engine. A second portion of the fuel is delivered to the filter for the sending unit through a reverse path for purging the filter of debris collected from the fuel.

19 Claims, 3 Drawing Sheets

SYSTEM FOR DELIVERING FUEL TO A MOTOR VEHICLE ENGINE AND RELATED METHOD

BACKGROUND OF THE INVENTION

1. Technical Field

The present invention generally pertains to motor vehicles. More particular, the present invention pertains to a system for delivering fuel to a motor vehicle engine and a related method. More specifically, but without restriction to the particular embodiment and/or use which is shown and described for purposes of illustration, the present invention relates to a fuel delivery system for a motor vehicle engine incorporating a fuel sending unit and a filter for filtering fluid drawn into the fuel sending unit. The system is operative for delivering a portion of fuel from the sending unit to the filter for purging the filter of accumulated debris.

2. Discussion

In many conventional motor vehicles, a fuel sending unit is provided for delivering the fuel to the engine. One such fuel sending unit A of the prior art is shown in FIG. 1 to include an intake B and an associated filter C for filtering the fuel as it is drawn into the sending unit A. Where the engine of the vehicle is fuel injected, a fuel regulator is provided between the sending unit A and the engine. The fuel regulator functions to deliver the fuel to the fuel injectors of the engine at a predetermined pressure. Excess fuel is bled off and returned to the tank through a fuel return D.

With such conventional systems, the filter which filters fuel drawn into the sending unit frequently becomes entrained with debris. This problem is particularly prevalent in underdeveloped countries where automotive fuel is contaminated. As a result, the debris may eventually be drawn through the filter or the filter may become blocked, thereby causing failure of the fuel delivery system.

Thus, it is desirable to provide a method and apparatus for delivering fuel to the engine of a motor vehicle which incorporates a self-cleaning fuel sending unit filter.

SUMMARY OF THE INVENTION

It is a general object of the present invention to provide an improved system and for delivering fuel to the engine of a motor vehicle which overcomes the above-noted problems associated with prior arrangements.

In one form, the present invention provides a system for delivering fuel from a fuel tank to an engine of a motor vehicle. The system includes a fuel sending unit for placement in the tank. The fuel sending unit is adapted to be in fluid communication with the engine. The fuel sending unit includes an intake for drawing the fuel from the fuel tank. The system additionally includes a filter operatively associated with the intake for filtering the fuel drawn into the fuel sending unit. The system further includes a tube attached to the filter operative for diverting a first portion of fuel from the fuel sending unit to the filter to purge the filter of debris.

In another form, the present invention provides a method for delivering a fuel from a fuel tank to an engine of a motor vehicle. The method includes the general steps of providing a fuel sending unit in fluid communication with the engine and drawing the fuel from the tank into the sending unit through a filter. The method additionally includes the steps of delivering a first portion of the fuel from the sending unit to the filter. Further, the method of the present invention includes the general step of purging the filter of debris with the first portion of fuel.

BRIEF DESCRIPTION OF THE DRAWINGS

The various advantages of the present invention will become apparent to one skilled in the art by reading the following specification and subjoined claims and by referencing the following drawings in which:

DETAILED DESCRIPTION OF THE PREFERRED EMBODIMENTS

Figure 2:
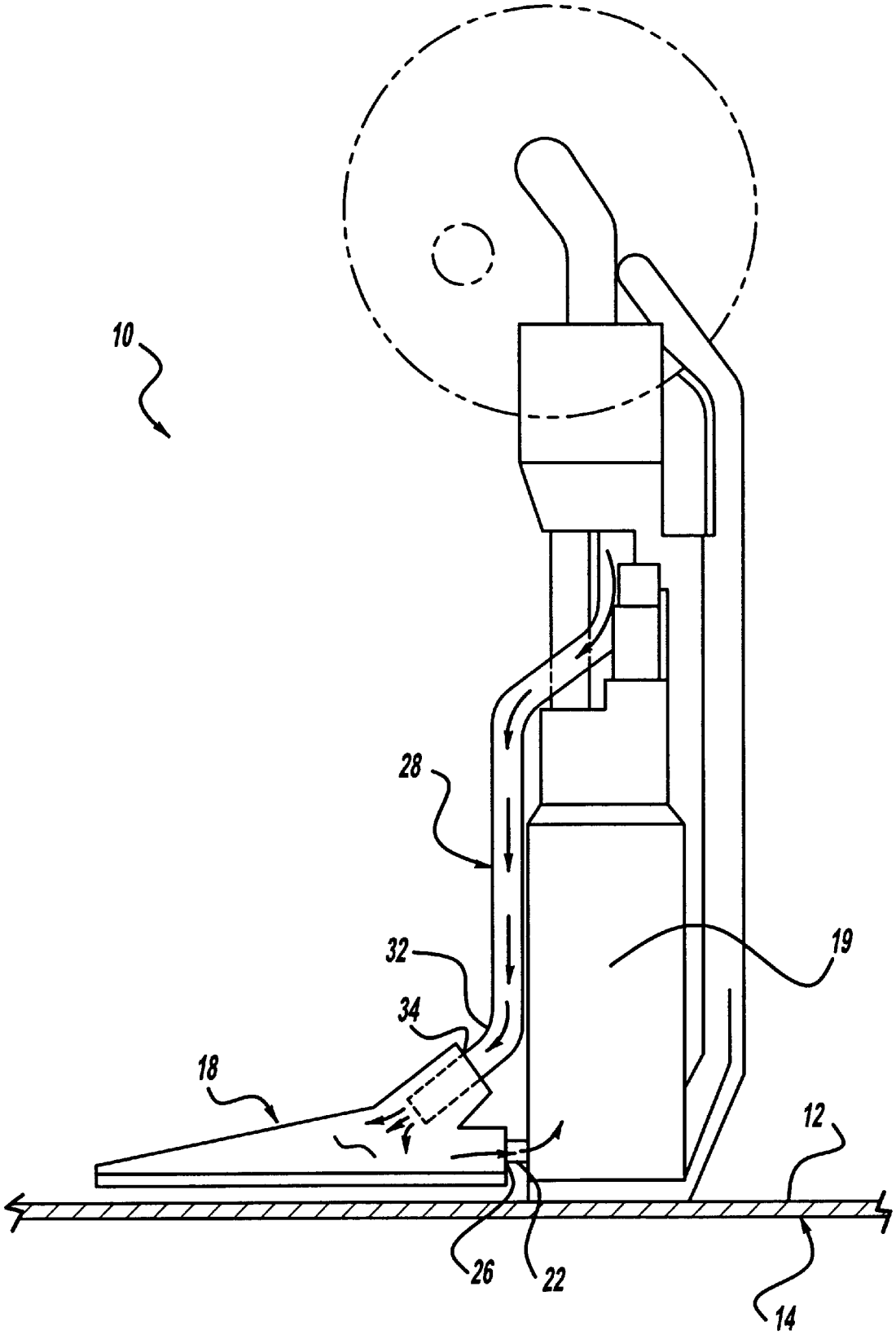
FIG. 2 is a view of a system for delivering fuel to a motor vehicle engine constructed in accordance with the teachings of a preferred embodiment of the present invention.
Figure 3:
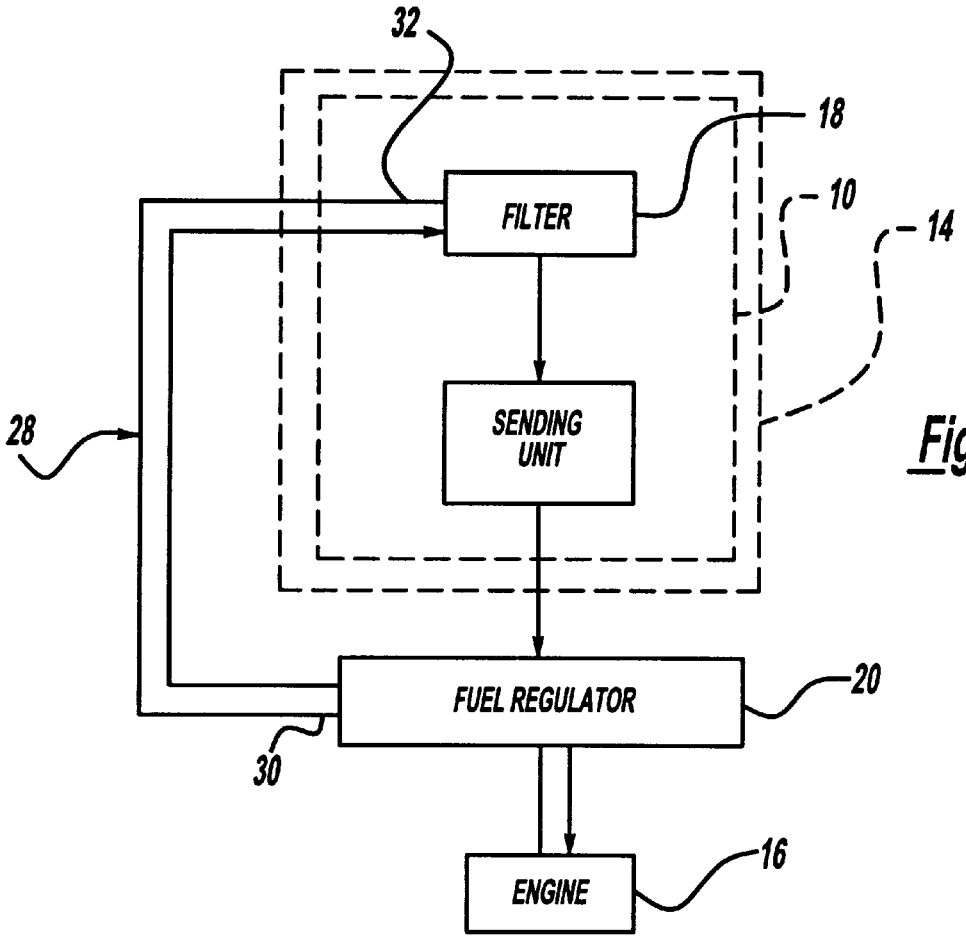
FIG. 3 is a schematic illustration of the system of FIG. 1 and a motor vehicle engine.

With reference to FIGS. 2 and 3, a sending unit constructed in accordance with the teachings of a preferred embodiment of the present invention is identified at reference numeral 10. The sending unit 10 is shown attached to a bottom surface 12 of a gas tank 14. To a significant degree, the sending unit 10 is conventional in construction and is adapted for delivering fuel (e.g., gasoline) to a motor vehicle engine 16. As will become apparent below, the present invention is specifically directed to an improved sending unit 10 which has a self-cleaning intake filter 18 and a related method of delivering fuel to a motor vehicle engine 16.

Figure 1:
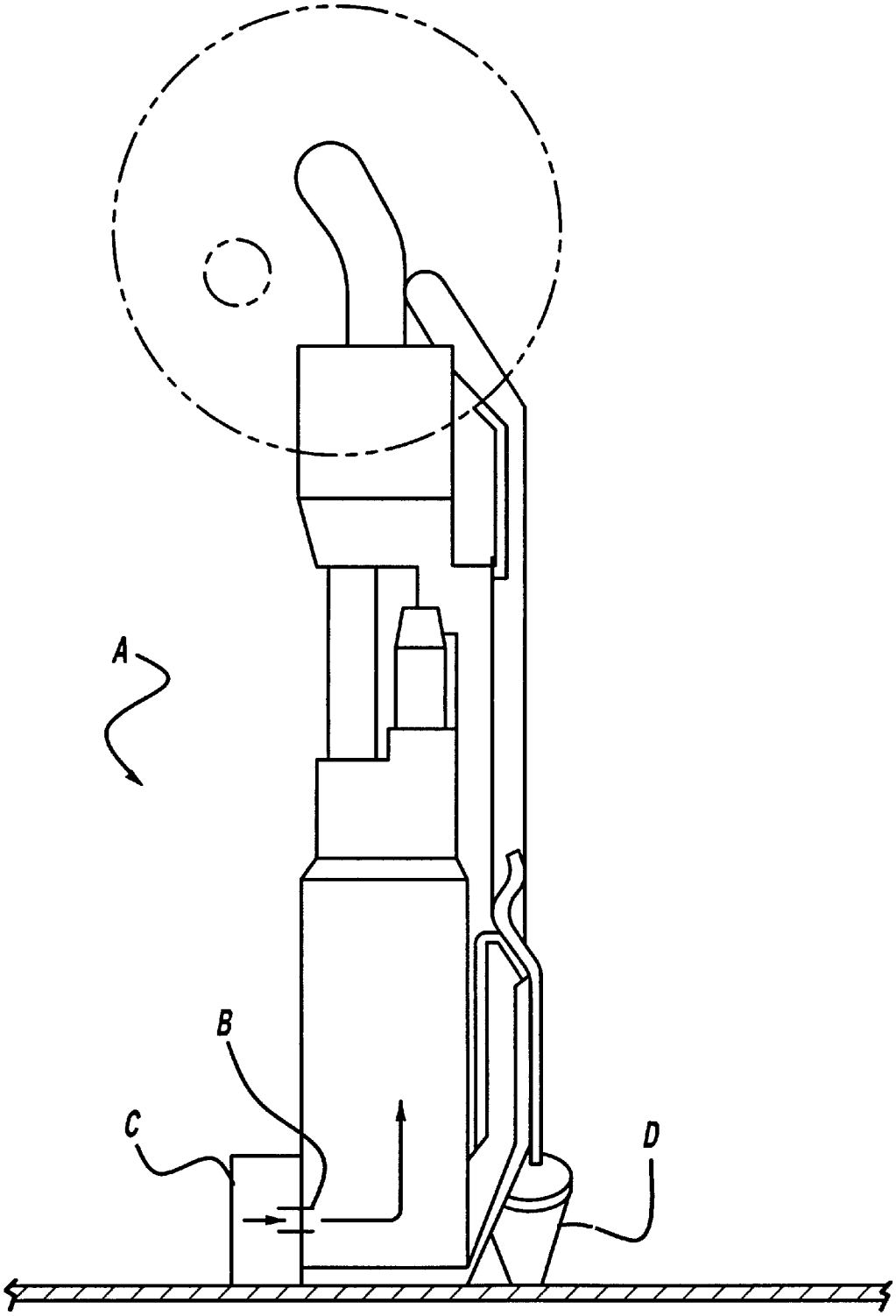
Figure - 1 Prior Art
FIG. 1 is an illustration of a prior art sending unit for delivering fuel to a motor vehicle engine.

The sending unit 10 of the present invention includes a fuel pump 19 which delivers fuel to a fuel regulator 20, which in turn delivers the fuel to fuel injectors of the engine 16 at a predetermined pressure. To obtain the desired fuel pressure for maximizing efficiency of the engine 16, the fuel regulator 20 functions to bleed off a portion of the fuel. In a conventional fuel system, this portion of the fuel is normally delivered directly to the fuel tank 14 through a return (as shown in FIG. 1). With the present invention, this portion of the fuel is routed back to the fuel tank 14 so as to flush the filter 18 of debris.

The filter 18 conventionally functions to filter fuel drawn from the tank 14 by the fuel pump 19. The fuel is drawn through an intake 22 disposed adjacent a bottom end 24 of the sending unit 10. The intake 22 of the sending unit 10 passes through an aperture 26 provided in the filter 18. The filter 18 is a sock-like member constructed of any suitably porous material adapted to filter debris from fuel. One suitable filter material is incorporated into a Bosch Corporation sending unit commercially available as part number 6002KP018. It will be appreciated by this skilled in the art that various other materials may be employed.

The sending unit 10 of the present invention is illustrated to further include a fuel return line 28 having a first end 30 and a second end 32. The first end 30 is in fluid communication with the fuel regulator 20 for returning the portion of bled fuel. The fuel return line 28 includes a second end 32 which passes through a second aperture 34 of the filter 18 and is disposed within an interior of the filter 18.

In operation, fuel is drawn into the intake 22 of the sending unit 10 through the filter 18. The fuel pump 19 delivers a portion of fuel to the fuel injectors of the engine 16 at a predetermined pressure. The remaining fuel is bled off and returned to the filter 18 for flushing the filter 18 of entrained debris. In one application, the fuel regulator diverts approximately fifty percent (50%) of the fuel to the filter 18. However, it will be understood that other fuel distribution ratios may be desired for other applications. In the preferred embodiment, fuel is returned to the filter 18 through the fuel return line 28 when the ignition key is turned to its "on" position. In this manner, the filter 18 can be flushed of debris during motor vehicle operation as well as prior to starting of the engine 16.

It will now be apparent that the present invention provides an improved sending unit 10 which utilizes fuel normally diverted from the engine 16 to flush the intake filter 18 of debris.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the description of the appended claims.

What is claimed is:

1. A system for delivering fuel from a fuel tank to an engine of a motor vehicle, the system comprising:

a fuel sending unit for placement in the fuel tank, said fuel sending unit adapted to be in fluid communication with the engine, said fuel sending unit including an intake for drawing the fuel from said fuel tank;

a filter operably associated with said intake for filtering the fuel drawn into said fuel sending unit; and means for delivering a first portion of fuel from said fuel sending unit directly to said filter and purging said filter of debris with said first portion of fuel.

2. The system for delivering fuel from a fuel tank to an engine of a motor vehicle of claim 1, wherein said means for delivering a first portion of fuel to said filter includes a fuel regulator for delivering fuel to the engine at a predetermined pressure.

3. The system for delivering fuel from a fuel tank to an engine of a motor vehicle of claim 2, wherein said means for delivering a first portion of fuel to said filter includes a fuel return line providing fluid communication between said fuel regulator and said filter.

4. The system for delivering fuel from a fuel tank to an engine of a motor vehicle of claim 3, wherein said filter is an enclosed, porous member defining an interior and further wherein said fuel return line includes a first end disposed in said interior.

5. The fuel system for delivering fuel from a fuel tank to an engine of a motor vehicle of claim 3, wherein said fuel regulator delivers a second portion of fuel to the engine.

6. The system for delivering fuel from a fuel tank to an engine of a motor vehicle of claim 1, wherein the means for delivering is operative for delivering the first portion of fuel directly to an interior of the filter.

7. A motor vehicle having a fuel injected engine and a fuel tank, in combination with a system for delivering a fuel from the tank to the engine, the system comprising:

a fuel sending unit disposed in the tank, said fuel sending unit in fluid communication with the fuel injected engine, said fuel sending unit including an intake for drawing the fuel from said fuel tank;

a filter operatively associated with said intake for filtering the fuel drawn into said fuel sending unit; and a fuel return line interconnected to said fueling sending unit for delivering a first portion of the fuel directly to said filter to purge said filter.

8. The system of claim 7, further comprising a fuel regulator interdisposed between said sending unit and said filter.

9. The system of claim 8, wherein said fuel return line includes a first end attached to said filter and a second end attached to fuel regulator.

10. The system of claim 9, wherein said filter is a closed porous member defining an interior.

11. The system of claim 10, wherein said second end of said fuel return line is disposed in said interior.

12. The system of claim 7, wherein said fuel regulator delivers a second portion of fuel to the engine.

13. The system of claim 7, wherein the fuel line is operative for delivering the first portion of fuel to an interior of the filter.

14. A method for delivering a fuel from a fuel tank to an engine of a motor vehicle, the method comprising the steps of:

providing a fuel sending unit in fluid communication with the engine;

drawing the fuel from the tank into said fuel sending unit through a filter;

delivering a first portion of the fuel from the sending unit directly to said filter; and purging said filter of debris with said first portion of fuel.

15. The method for delivering a fuel from a fuel tank to an engine of a motor vehicle of claim 14, further comprising the steps of providing a fuel regulator; and delivering a second portion of fuel with the fuel regulator to the engine at a predetermined pressure.

16. The method for delivering a fuel from a fuel tank to an engine of a motor vehicle of claim 15, wherein said step of purging said filter includes the step of diverting said first portion of fuel from the engine with said fuel regulator.

17. The method for delivering a fuel from a fuel tank to an engine of a motor vehicle of claim 16, wherein said step of diverting said first portion of fuel includes the step of providing fuel return line connecting said fuel regulator and said filter.

18. The method for delivering a fuel from a fuel tank to an engine of a motor vehicle of claim 17, wherein said step of purging said filter includes the step of delivering said first portion of fuel to an interior of said filter.

19. The method for delivering a fuel from a fuel tank to an engine of a motor vehicle of claim 14, wherein the step of delivering a first portion of fuel includes the step of delivering the first portion of fuel directly to an interior of the filter.

* * * * *